US010301096B2

(12) United States Patent
Stever et al.

(10) Patent No.: US 10,301,096 B2
(45) **Date of Patent: *May 28, 2019**

(54) PIERCE AT FIRST USE FLUID DISPENSING VALVE AND FLEXIBLE PACKAGE INCLUDING THE SAME

(71) Applicant: Fres-co System USA, Inc., Telford, PA (US)

(72) Inventors: Raymond Andrew Stever, Reading, PA (US); Jeffrey Scott Beer, Coopersburg, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/833,485

(22) Filed: Dec. 6, 2017

(65) Prior Publication Data

US 2018/0093808 A1 Apr. 5, 2018

Related U.S. Application Data

(63) Continuation of application No. 15/201,767, filed on Jul. 5, 2016, now Pat. No. 9,862,533.
(Continued)

(51) Int. Cl.
*B65D 77/06* (2006.01)
*B67D 3/00* (2006.01)
(Continued)

(52) U.S. Cl.
CPC ..... *B65D 77/067* (2013.01); *B67B 7/26* (2013.01); *B67D 3/0067* (2013.01); *B67D 3/043* (2013.01)

(58) Field of Classification Search
CPC .... B65D 77/067; B67D 3/0067; B67D 3/043; B67B 7/26
See application file for complete search history.

(56) References Cited

U.S. PATENT DOCUMENTS 3,696,969 A 10/1972 De Van et al.
4,314,654 A 2/1982 Gaubert
(Continued)

FOREIGN PATENT DOCUMENTS

AU 541628 B2 1/1985
EP 0553956 A1 8/1993
(Continued)

OTHER PUBLICATIONS

International Search Report for PCT/US2016/041077 dated Dec. 2, 2016.

*Primary Examiner* — Frederick C Nicolas
(74) *Attorney, Agent, or Firm* — Caesar Rivise, PC

(57) ABSTRACT

A package including a fitment for dispensing a liquid from a flexible bag is disclosed. The fitment is secured to the bag and includes a compressible bulb and a piercing member that are coupled together. The fitment is configured such that when the bulb is first actuated, e.g., pressed, it causes the piercing member to pierce through the wall of the bag so that the contents of the bag can be dispensed through an outlet port of the fitment. In one embodiment of the fitment a portion of the piercing member is permanently located within the bag after first use and a valve is provided to open and close the outlet port thereafter. In another and more preferred embodiment the piercing member is extended into and out of the bag to dispense the contents of the bag through the outlet port, without necessitating use of a separate valve to open and close that port.

25 Claims, 13 Drawing Sheets

Related U.S. Application Data

(60) Provisional application No. 62/189,428, filed on Jul. 7, 2015.

(51) Int. Cl.
*B67D 3/04* (2006.01)
*B67B 7/00* (2006.01)

(56) References Cited

U.S. PATENT DOCUMENTS

| | | | |
|---|---|---|---|
| 4,416,395 | A | 11/1983 | Gaubert |
| 4,429,810 | A | 2/1984 | Hampel et al. |
| 4,440,316 | A | 4/1984 | Christine |
| 4,452,378 | A | 6/1984 | Christine |
| 4,475,670 | A | 10/1984 | Rutter |
| 4,602,725 | A | 7/1986 | Malpas et al. |
| 4,619,377 | A | 10/1986 | Roos |
| 4,624,392 | A | 11/1986 | Malpas et al. |
| 5,111,970 | A | 5/1992 | Rutter et al. |
| 5,337,775 | A | 8/1994 | Lane |
| 6,131,767 | A | 10/2000 | Savage et al. |
| 6,354,466 | B1 | 3/2002 | Karpisek |
| 6,446,845 | B1 | 9/2002 | Steiger |
| 7,188,749 | B2 | 3/2007 | Miller et al. |
| 7,303,713 | B2 | 12/2007 | Gabriel et al. |
| 7,708,164 | B2 | 5/2010 | Pritchard |
| 7,789,269 | B2 | 9/2010 | Prtichard |
| 8,353,428 | B2 | 1/2013 | Pritchard |
| 8,695,851 | B2 | 4/2014 | Pritchard |
| 8,967,430 | B2 | 3/2015 | Wrigley |
| 9,862,533 | B2 * | 1/2018 | Stever ..... B67D 3/043 |

FOREIGN PATENT DOCUMENTS

| | | | |
|---|---|---|---|
| GB | 2082152 | A | 3/1982 |
| WO | 2006097704 | A1 | 9/2006 |

* cited by examiner

PIERCE AT FIRST USE FLUID DISPENSING VALVE AND FLEXIBLE PACKAGE INCLUDING THE SAME

CROSS-REFERENCE TO RELATED APPLICATIONS

This continuation application claims the benefit under 35 U.S.C. § 120 of U.S. application Ser. No. 15/201,767, filed on Jul. 5, 2016 entitled Pierce At First Use Fluid Dispensing Valve And Flexible Package Including the Same, which in turn claims the benefit under 35 U.S.C. § 119(e) of U.S. Provisional Application Ser. No. 62/189,428 filed on Jul. 7, 2015, entitled Pierce At First Use Fluid Dispensing Valve And Flexible Package Including The Same. The entire disclosures of all of the foregoing applications are hereby incorporated by reference herein.

BACKGROUND OF THE INVENTION

Field of Invention

This invention relates generally to flexible packages and more particularly to flexible packages including a fitment for dispensing a metered amount of liquid within the packages.

Description of Related Art

Various packages for dispensing bulk fluids are commercially available. One of the most common types of such packages are so-called "bag-in-box" packages. Those packages include a rigid, generally parallelepiped outer container which houses and protects a flexible bag therein. The flexible bag is sealed and holds the liquid to be dispensed via an externally located tap or fitment that is connected to the bag. One of the most popular types of "bag-in-box" constructions is used for wines, water and other liquids dispensed in commercial environments. As will be appreciated by those skilled in the art, the external attachment of the tap and/or dispensing fitment to the flexible bag permits storage of liquid in air-tight and even sterile condition until, and possibly even after, such time as fluid is dispensed. Improvements to such constructions have also been made with the tap and/or fitment attached to the sealed bag with no port or hole in bag for the fluid to exit until the first use of the tap or fitment, whereby a piercing member is activated to create an opening in the bag wall that allows the liquid to flow into the device to be dispensed through its exit port.

Numerous patents disclose flexible packages for holding liquids and for dispensing the liquid through a fitment outlet or tap forming a portion of the package. See for example, U.S. Pat. No. 4,429,810 (Hample et al.); U.S. Pat. No. 3,696,969 (De Van et al.); U.S. Pat. No. 4,314,654 (Gaubert); U.S. Pat. No. 4,416,395 (Gaubert); U.S. Pat. No. 4,440,316 (Christine); U.S. Pat. No. 4,452,378 (Christine); U.S. Pat. No. 4,475,670 (Rutter); U.S. Pat. No. 4,602,725 (Malpas et al.); U.S. Pat. No. 4,624,392 (Malpas et al.); U.S. Pat. No. 5,111,970 (Rutter et al.); U.S. Pat. No. 4,619,377 (Roos); U.S. Pat. No. 6,131,767 (Savage et al.); U.S. Pat. No. 6,354,466 (Karpisek); U.S. Pat. No. 6,446,845 (Steiger); U.S. Pat. No. 7,188,749 (Miller et al.); U.S. Pat. No. 7,303,713 (Gabriel et al.); U.S. Pat. No. 7,708,164 (Pritchard); U.S. Pat. No. 7,789,269 (Pritchard); U.S. Pat. No. 8,695,851 (Pritchard); and U.S. Pat. No. 8,967,430 (Wrigley).

While the aforementioned packages with fitments may be generally suitable for their intended purposes, they suffer from one or more drawbacks, e.g., simplicity of construction, cost, ease of use, flow rate, etc. The subject invention addresses the needs of the prior art.

SUMMARY OF THE INVENTION

In accordance with one aspect of this invention a fitment for package holding a liquid therein for selectively dispensing a quantity of the liquid from the package is provided. The package comprises a flexible bag having a hollow interior in which the liquid is disposed and a wall contiguous with the hollow interior. The fitment comprises a body, a plunger, a valve, an actuator, and a piercing member. The body has a portion configured for securement to the wall of the bag, a passageway, and an outlet in communication with the passageway. The actuator comprises a member configured to be depressed and released. The plunger is coupled to the actuator and configured to be moved through the passageway in one direction to an extended position upon the depression of the actuator and moved through the passageway in a second, e.g., opposite, direction to a retracted position in automatic response to the release of the actuator. The piercing member comprises a hollow member coupled to the plunger and located in the passageway. The plunger when moved to the extended positon causes the piercing member to pierce through the wall of the bag, whereupon a portion of the piercing member is permanently disposed within the hollow interior of the bag and a portion of the piercing member is located outside of the bag. The valve is coupled to the actuator and configured to be in either an open state or a closed state. The valve is in the open state when the actuator is depressed and is in the closed state when the actuator is released. In the open state the valve enables the liquid within the hollow interior of the bag to flow out of the bag through the piercing member and the passageway to the outlet.

In accordance with another aspect of this invention another and more preferred fitment for package holding a liquid therein for selectively dispensing a quantity of the liquid from the package is provided. The package comprises a flexible bag having a hollow interior in which the liquid is disposed and a wall contiguous with the hollow interior. The other fitment comprises a body, an actuator and a piercing member. The body has a portion configured for securement to the wall of the bag, a passageway, and an outlet port in communication with the passageway. The actuator comprises a member configured to be repeatedly depressed and released. The piercing member comprises a hollow cylindrical section having an outer surface. The piercing member is coupled to the actuator and configured to be moved in one direction through the passageway and through the wall of the bag to an extended position upon the depression of the actuator and moved in a second and opposite direction back through the wall of the bag and through the passageway to a fully retracted position in automatic response to the release of the actuator. One of the passageway and the outer surface of the piercing member comprises at least one seal. The outer surface of the piercing member and the at least one seal form a fluid tight interface therebetween. The piercing member includes a portion blocking the outlet port when the piercing member is in the fully retracted position, and unblocking the outlet portion when the piercing member is moved to the extended position, thereby enabling the liquid within the hollow interior of the bag to flow out of the bag through the hollow cylindrical section of the piercing member and the passageway to the outlet.

In accordance with other aspects of this invention packages including fitments like that described above are provided.

DESCRIPTION OF THE DRAWING

The invention will be described in conjunction with the following drawings in which like reference numerals designate like elements and wherein.

DETAILED DESCRIPTION OF THE PREFERRED EMBODIMENT

Figure 1:
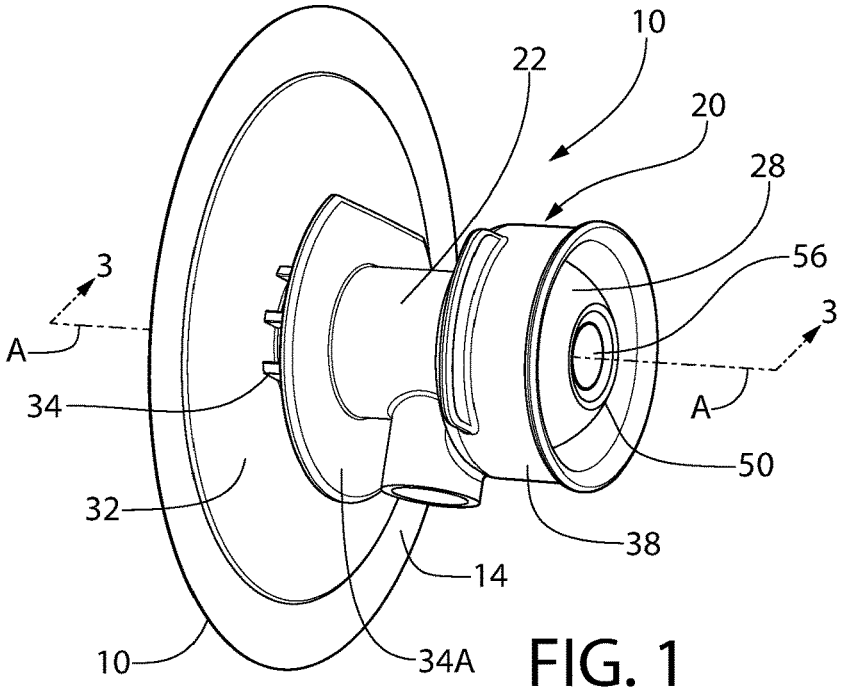
FIG. 1 is an isometric view of one exemplary package, e.g., a flexible pouch or bag, including a fitment constructed in accordance with this invention.

Referring now to the various figures of the drawing wherein like reference characters refer to like parts, there is shown in FIG. 1 one exemplary embodiment of a package 10 constructed in accordance with one aspect of this invention. The package is arranged for holding and dispensing a flowable material, e.g., a liquid, therefrom by means of a dispensing fitment 20 constructed in accordance with this invention. In the exemplary embodiment shown the package 10 is in the form of a bag or pouch formed of flexible sheet material bounding a hollow interior 12 (FIG. 3) in which the liquid to be dispensed is located. The bag or pouch 10 may form a portion of a conventional "bag-in-box", wherein the bag or pouch 10 is located within an outer container, e.g., a box (not shown). The bag or pouch can be of any conventional construction, e.g., it may be formed of a polymeric film of one or more layers. The fitment 20 is fixedly mounted, e.g., welded, on an exterior surface 12 of a portion of one of the walls making up the bag or pouch.

The fitment 20 basically comprises an assembly of a body or housing 22, a plunger 24, a valve 26, an actuator 28, and a piercing member 30. The body 22 is a molded, hollow component having a planar flange 32 configured to be fixedly secured, e.g., welded, to the outer surface of a portion of the wall 14 of the bag 10. The portion of the body 22 contiguous with the flange is in the form of a collar 34. The collar 34 includes a flange 34A projecting outward from its proximal end. The flange 34A is configured to receive a portion of the wall of the box between it and the flange 32, when the fitment is used as a part of a bag-in-box package. It should be pointed out that such use is merely exemplary, such that the fitment of this invention can be used for other applications than bag-in-box.

Figure 2:
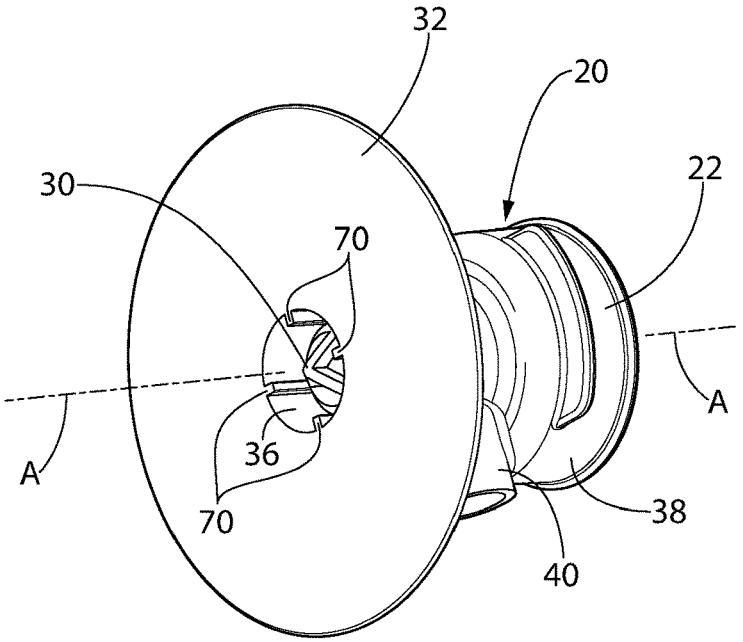
FIG. 2 is an isometric view of the fitment shown in FIG. 1, wherein the fitment is shown prior to being secured to the bag.
Figure 3:
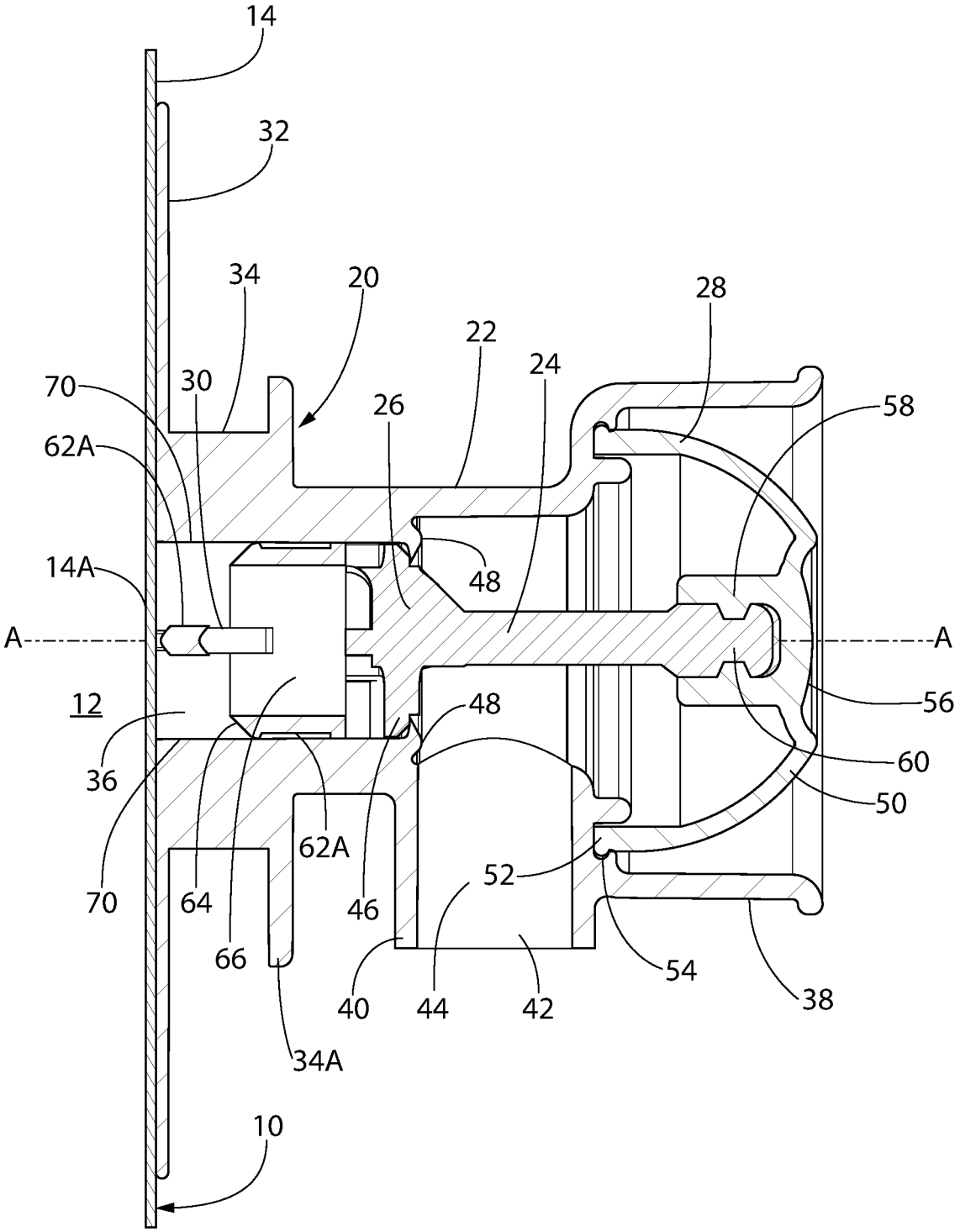
FIG. 3 is an enlarged sectional view taken along line 3-3 of FIG. 1, wherein the fitment is shown in its initial state prior to first use.

The body 22 of the fitment includes a central passageway 36 extending partially through it. The passageway is centered about a longitudinally extending axis A. The passageway 36 is at the end of the body 22 contiguous with the flange 32 and is open, whereupon a portion 14A of the wall 14 of the bag is in communication with the passageway 36. That portion 14A forms a frangible penetration zone in the bag (i.e., the portion of the bag that will be penetrated by the piercing member 30, as will be described later). The open end of the central passageway is best seen in FIGS. 2 and 3 and forms the inlet to the fitment through which the liquid in the bag may enter when the frangible penetration zone of the bag is pierced.

The opposite end of the fitment's body 22 is in the form of a hollow tubular throat 38, which is centered on the axis A and whose inside diameter is larger than the inside diameter of the passageway 36. The portion of the body 22 located between the tubular throat 38 and the collar 34 is in the form of an outlet or spout 40. The spout 40 constitutes a tubular portion of the body which extends generally perpendicularly to the longitudinal central axis A and has an open end 42 which forms the outlet of the fitment 20. A passageway 44 extends through the spout from the open end 42 to the central passageway 36. It is through the spout that the liquid is dispensed from the bag.

The valve 26 basically comprises a valve member 46 and a valve seat 48. The valve member forms an integral portion of the plunger and is preferably molded of a suitable plastic material, e.g., high density polyethylene. The valve member is configured to move with the plunger between a closed and open position, and vice versa. The movement of the valve member from the closed position to the open position selectively opens the valve to enable the liquid within the bag to be dispensed from the bag. Conversely, when the valve is moved to its closed state it halts the flow of liquid from the bag.

Figure 9:
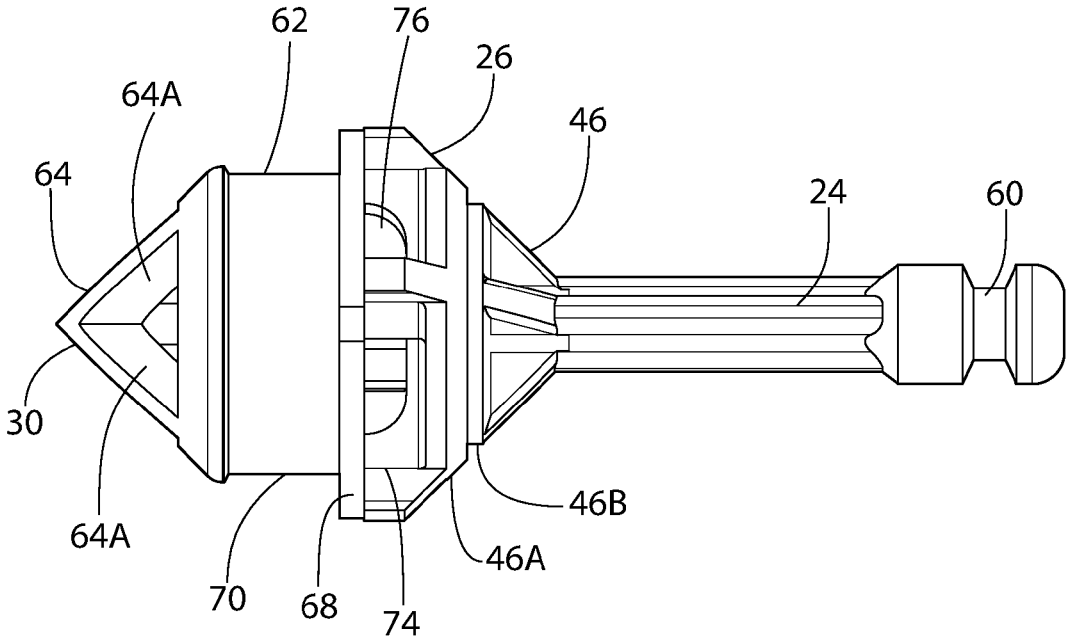
FIG. 9 is a side elevation view of several of the components of the fitment shown in FIGS. 1-5.
Figure 10:
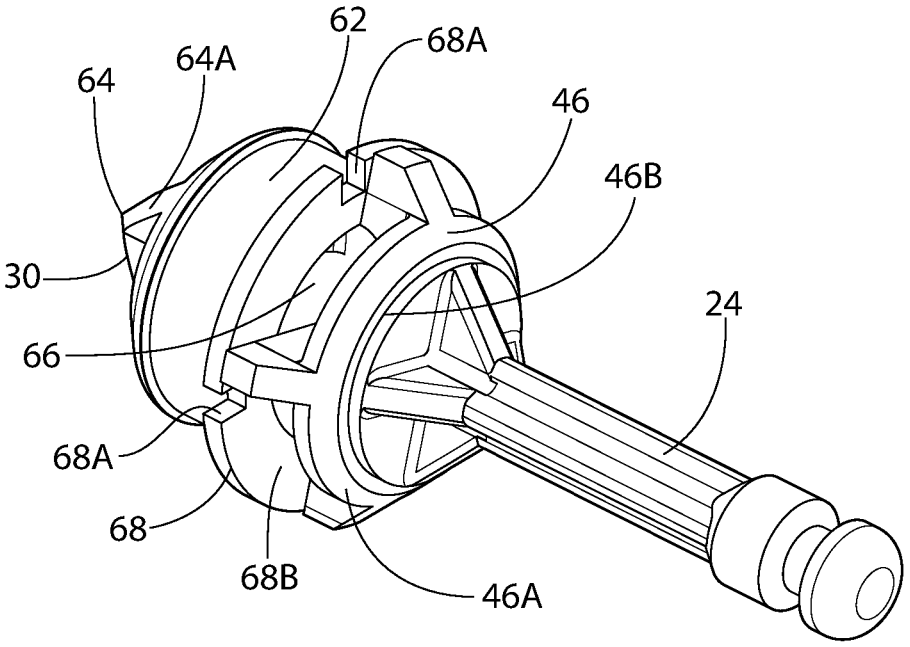
FIG. 10 is an isometric view of the components shown in FIG. 9.
Figure 11:
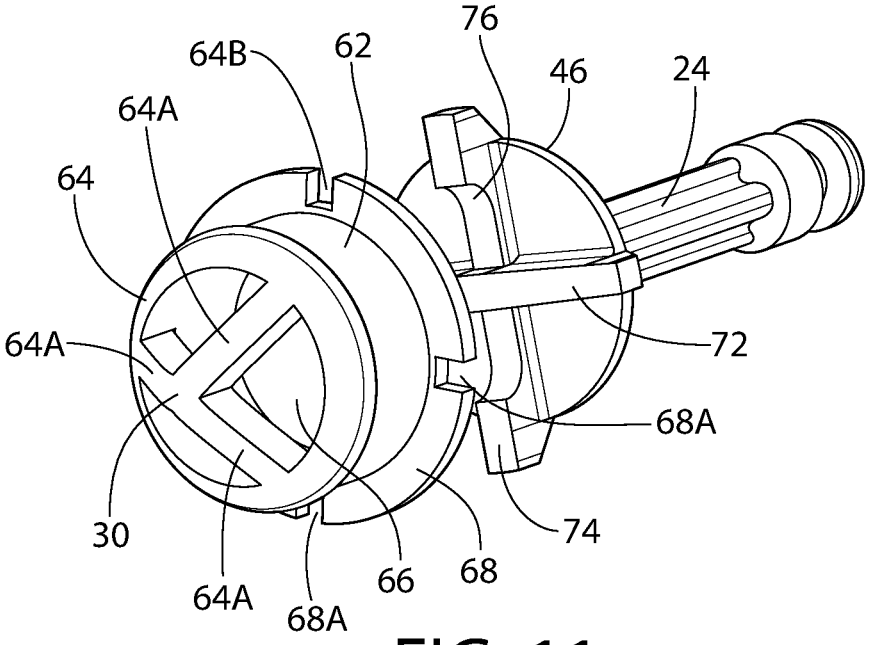
FIG. 11 is an exploded isometric view of the components shown in FIGS. 9 and 10.
Figure 12:
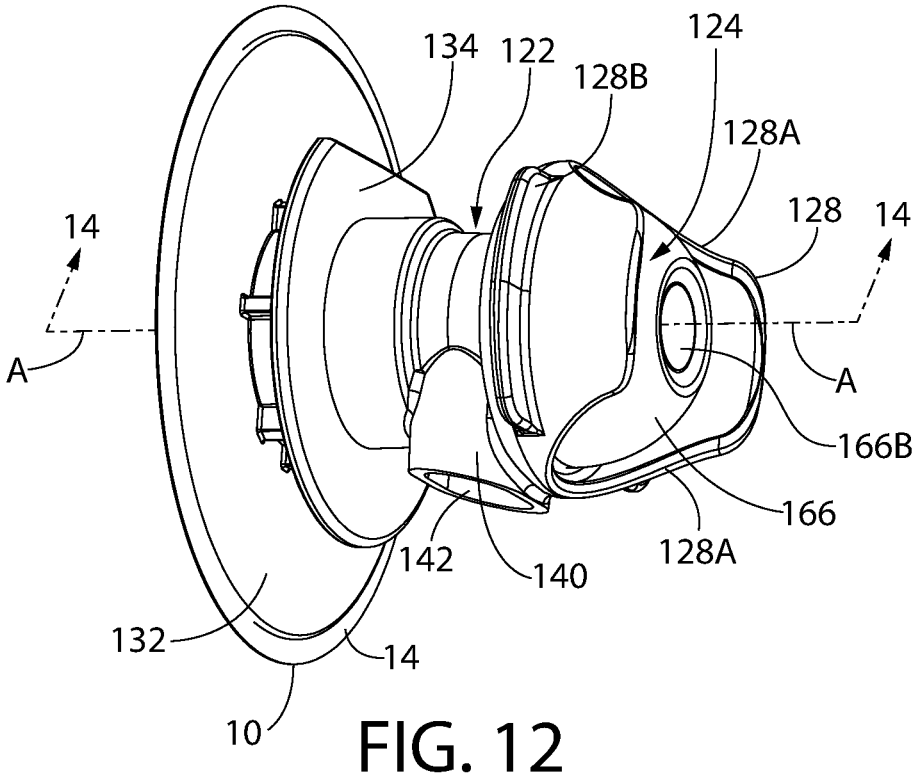
FIG. 12 is an isometric view, similar to FIG. 1, but showing another exemplary package, e.g., a flexible pouch or bag, including a more preferred embodiment of a fitment constructed in accordance with this invention.

The valve member is best seen in FIGS. 9 and 10 and basically comprises a flanged projection located at the distal end portion of the plunger. The valve body has a sloping, e.g., 45 degree, proximally facing surface. A peripheral portion of that proximally facing surface is designated by the reference number 46A and cooperates with a portion of the valve seat 48 to form a first circular compression seal when the valve is closed. A 90 degree angled annular ledge 46B is located immediately proximally of the sloped surface 46A and forms a second circular compression seal with an associated portion of the valve seat 48 when the valve is closed. As best seen in FIG. 11, the distal surface of the valve member is planar and includes two walls 72 and 74 projecting outward therefrom. The top surfaces of those walls are coplanar and form pusher surfaces which are arranged to engage the proximal end surface of the piercing member (to be described later) to push the piercing member through the frangible zone 14A of the bag when the fitment is first used. The wall 74 includes a recess 76 to serve as a fluid passageway when the walls 72 and 74 are in engagement with the proximal surface of the piercing member.

The valve seat 48 is best seen in FIGS. 3, 4, 7 and 8 and is in the form of an annular wall projecting inward radially from the fitment's body 22 into the central passageway 36 at the portion of that passageway that merges with the passageway 44 of the spout 40. The annular wall 48 tapers in cross-section to a relatively sharp free edge. In accordance with one preferred exemplary embodiment of this invention the valve body is an integral member molded of a suitable plastic, e.g., linear low density polyethylene. Thus, the inwardly projecting valve seat is somewhat flexible.

The valve member is configured to be moved between a closed state and an open state, and vice versa, in response to the operation of the actuator. When the valve 26 is in its closed state the free end of the tapered valve seat 48 will be flexed and disposed in intimate engagement within the annular ledge 46A of the valve member to form the first of the aforementioned compression seals. At the same time the portion of the valve seat contiguous with its sharpened inner edge will be flexed and in intimate engagement with the contiguous portion sloping proximal surface 46A of the valve member 46 to form the second of the aforementioned compression seals. Those two compression seals serve to isolate the central passageway 36 from the spout's passageway 44 and thereby prevent any liquid within the central passageway from flowing into the spout. Conversely, when the valve 26 is in its open state, the valve member 46 is spaced off of the valve seat 48 so that the central passageway 36 is in fluid communication with the spout passageway 44 via the open space between the valve member and the valve seat. Thus, liquid may flow from the central passageway into the spout passageway and out of the open end of the spout.

As best seen in FIGS. 9 and 10, the plunger 24 is an elongated rod-like member of generally cruciform cross-section having a distal end and a proximal end. The plunger is disposed within the fitment's central passageway 36 centered along the longitudinal axis A for reciprocating (e.g., sliding) movement therealong. To that end, the plunger is coupled to the actuator 28 so that manual depression of the actuator by a user causes the plunger to move through the central passageway 36 along the axis A in the distal direction to its extended position, whereupon the valve 26 is open. Owing to the construction of the actuator, the plunger is also configured to be moved through the central passageway 36 along the central longitudinal axis A in the proximal direction to its retracted position in automatic response to the release of the actuator. When the plunger is in the retracted position the valve is closed.

Figure 6:
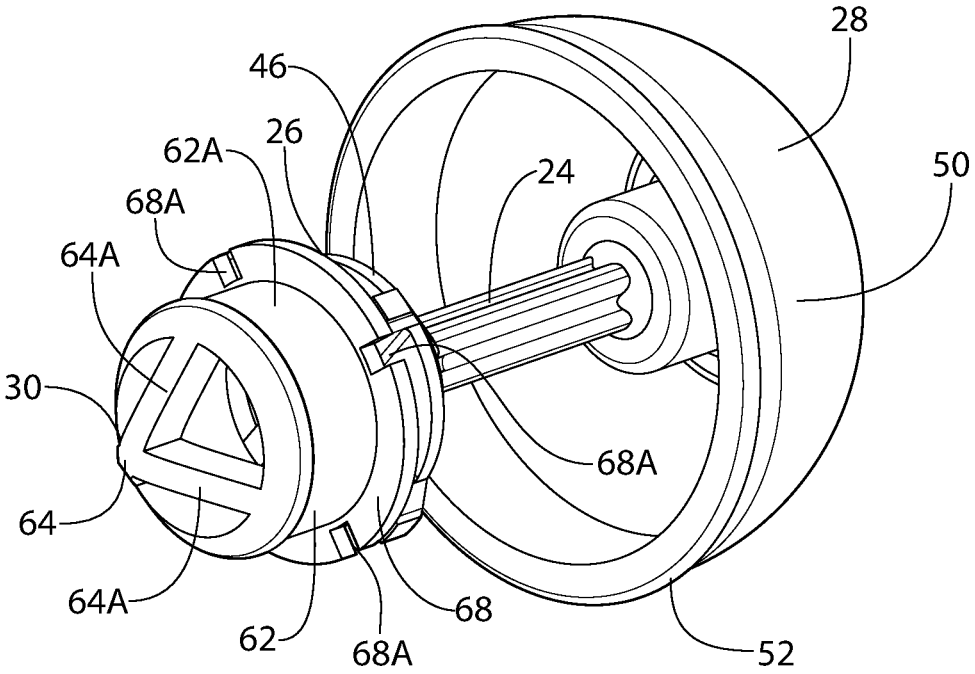
FIG. 6 is an enlarged isometric view of a portion of some of the components of the fitment shown in FIGS. 1-5.
Figure 7:
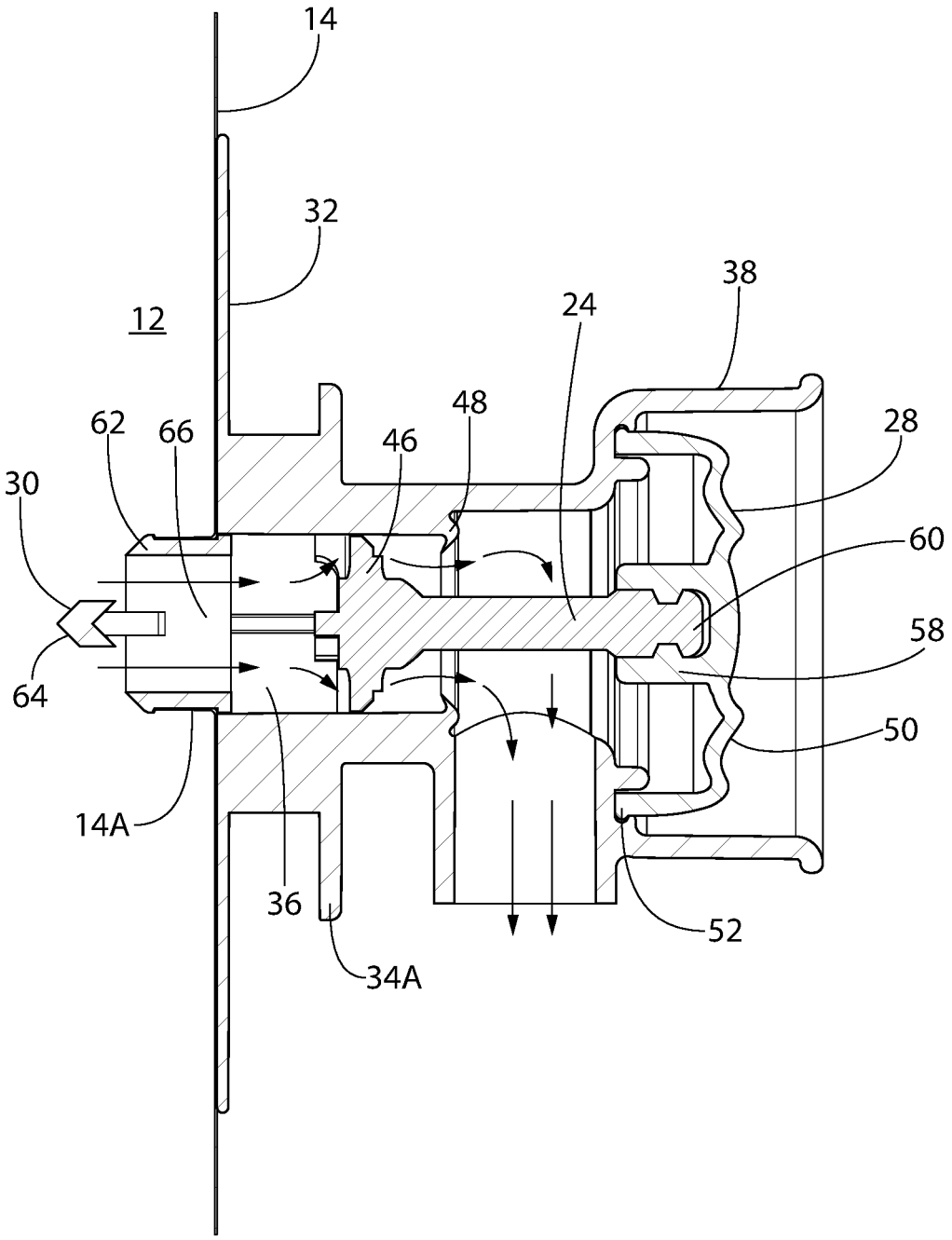
FIG. 7 is a sectional view, similar to FIG. 4, but showing the fitment after a portion of it has pierced the wall of the bag, but with the fitment's valve in its open state to enable the flowable contents of the bag to flow out of the bag through the fitment.
Figure 8:
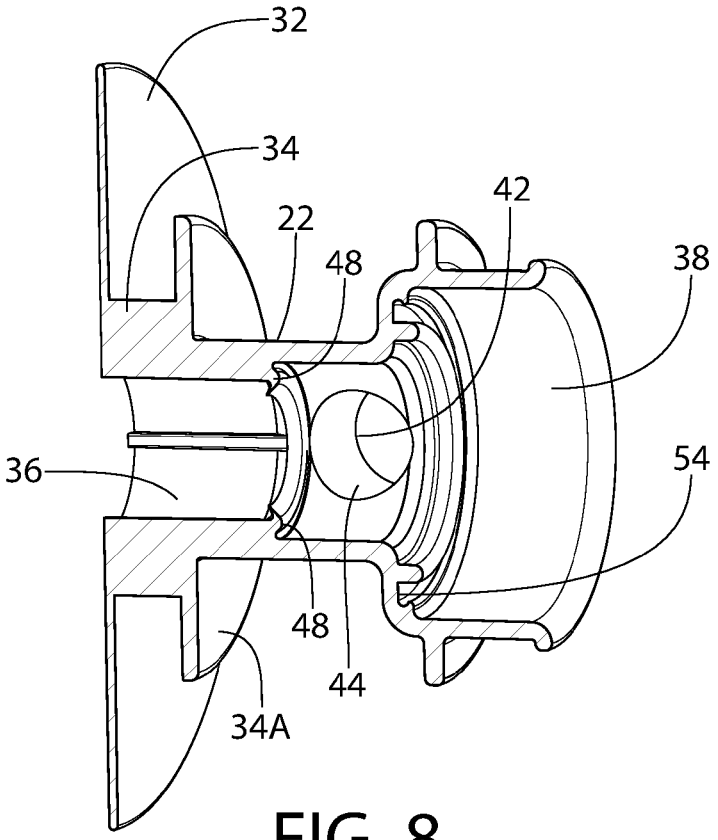
FIG. 8 is an enlarged isometric view, partially in section, showing one component, i.e., the body or housing of the fitment of FIG. 1.

The proximal end of the plunger 24 is connected to the actuator 28. The actuator comprises a depressible member configured to be repeatedly depressed and released to effect its operation. In the exemplary embodiment shown the actuator is in the form of a compressible bulb 50 formed of any suitable resilient material, e.g., a thermoplastic polyester elastomer such as HYTREL® of DuPont. The compressible bulb is of generally hemispheric shape having an annular peripheral flanged rim 52 (FIGS. 3 and 6) which is secured within a correspondingly shaped annular recess 54 (FIG. 3) located at the bottom of the throat 28. The apex of the compressible bulb 54 is in the form of a slight depression 56. The inner surface of the bulb 50 at the location of the depression 56 is in the form of a socket 58 in which the proximal end 60 of the plunger is fixedly secured.

The bulb 50 is configured to be pressed by a user's finger or thumb to collapse the bulb. This action has the effect of sliding the plunger through the body of the fitment along the axis A to the extended position, whereupon the valve member 46 is brought out of engagement with the valve seat 48, like shown in FIG. 7, to thereby open the valve 26. Inasmuch as the compressible bulb is formed of a resilient material, the release of pressure on the bulb by the user enables the bulb to automatically reassume its normal un-collapsed state, whereupon the plunger 24 is carried back to its retracted position, thereby closing the valve 26.

The details of the construction and operation of the piercing member 30 will be described shortly. Suffice it for now to state that the piercing member is releasably disposed on the plunger and configured so that when the plunger is initially moved (e.g., slid) to the extended position it will push a tip portion of the piercing member through the frangible zone 14A of the bag's wall 14 to pierce or penetrate that wall portion, whereupon the tip and a contiguous portion of the piercing member will be located within the interior of the bag. Once the piercing tip portion is so positioned, and pressure released on the bulb 50, the plunger will move back to its retracted position, leaving the piercing tip permanently located within the hollow interior of the bag, with another portion of the piercing member permanently located outside the outer surface of the bag. Thus, the piercing member (which had been temporarily disposed on the valve member of the plunger) will be freed from the plunger so that it will not move with any subsequent movement of the plunger in opening and closing the valve. The decoupling of the piercing member from the plunger enables the plunger to move the valve to its open or closed position, without affecting the positioning of the piercing member. Thus, the valve can be operated independently to enable liquid from the bag to flow out of the fitment's spout when desired and to halt such flow when that action is desired.

Figure 4:
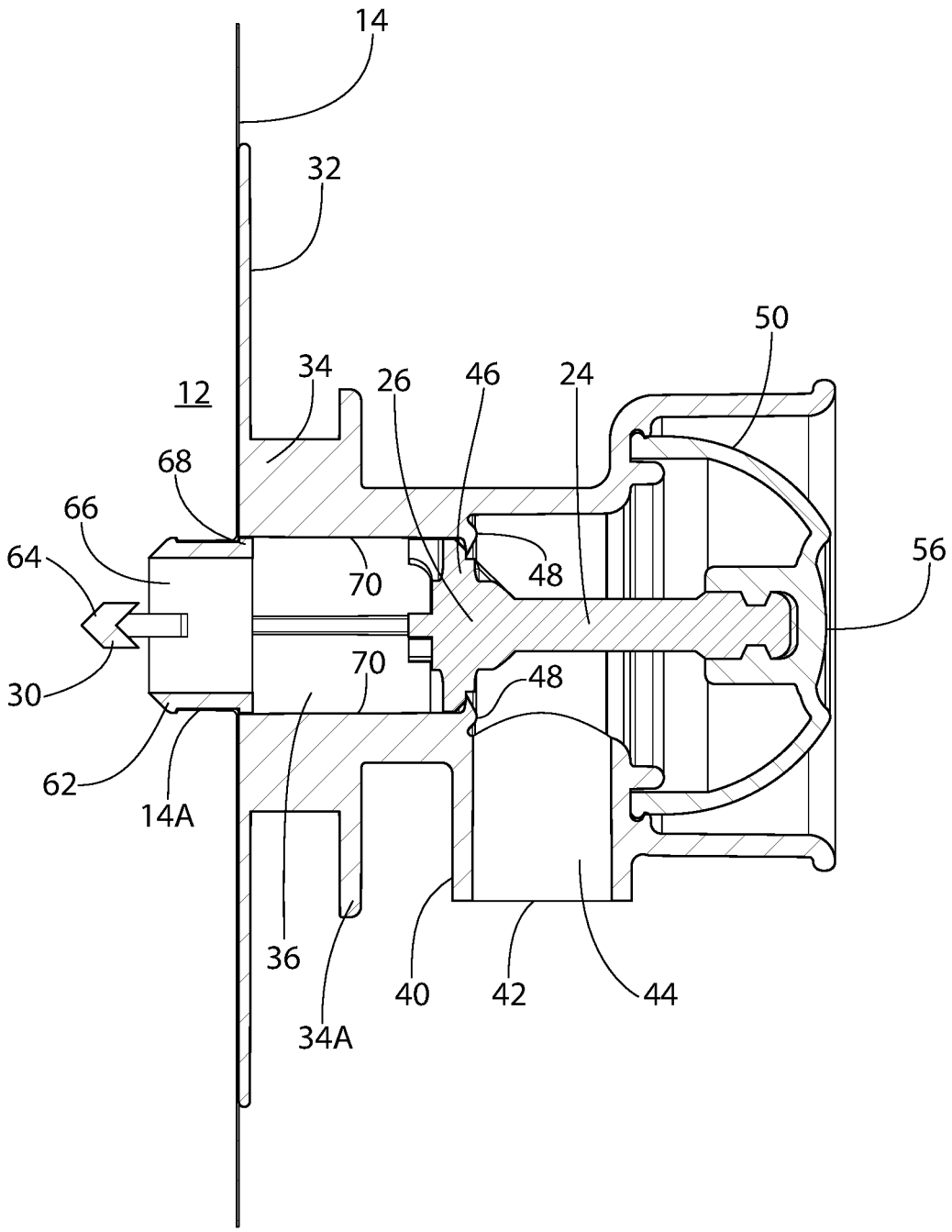
FIG. 4 is an enlarged sectional view, similar to FIG. 3, but showing the fitment after a portion of it has pierced the wall of the bag, but with a valve forming a portion of the fitment in its closed state, whereupon the flowable contents in the bag is precluded from flowing out of the fitment.

As best seen in FIGS. 9-11, the piercing member 30 is disposed within the central passageway 36 of the body at the location of the distal end-surface of the valve member, i.e., on the planar surfaces of the pusher walls 72 and 74, but is not secured to the valve member. The piercing member basically comprises a tubular proximally located section 62 and a pointed distally located tip 64. In accordance with a preferred exemplary embodiment of this invention the piercing member is an integral unit molded of the same plastic material as that making up the integral plunger and valve member. The tubular section 62 has a central passageway 66 extending therethrough and a flange 68 located at its proximal end. The tip 64 comprises an extension of the distal end of the tubular section 62 and includes plural, e.g., 3, legs 64A merging together at a point. The space between adjacent legs is in fluid communication with the passageway 66 of the tubular section 62. A shallow annular recess 62A is located in the outer surface of the tubular section 62. The flange 68 includes plural notches 68A equidistantly spaced about the periphery of the flange and a planar rear surface 68B. The notches 68A are arranged to receive respective linear rails 70 (FIG. 2) extending along the passageway 36 parallel to the axis A to enable the piercing member to be slid (pushed) from its retracted position, such as shown in FIG. 3, to its extended position, such as shown in FIGS. 4 and 5.

Figure 5:
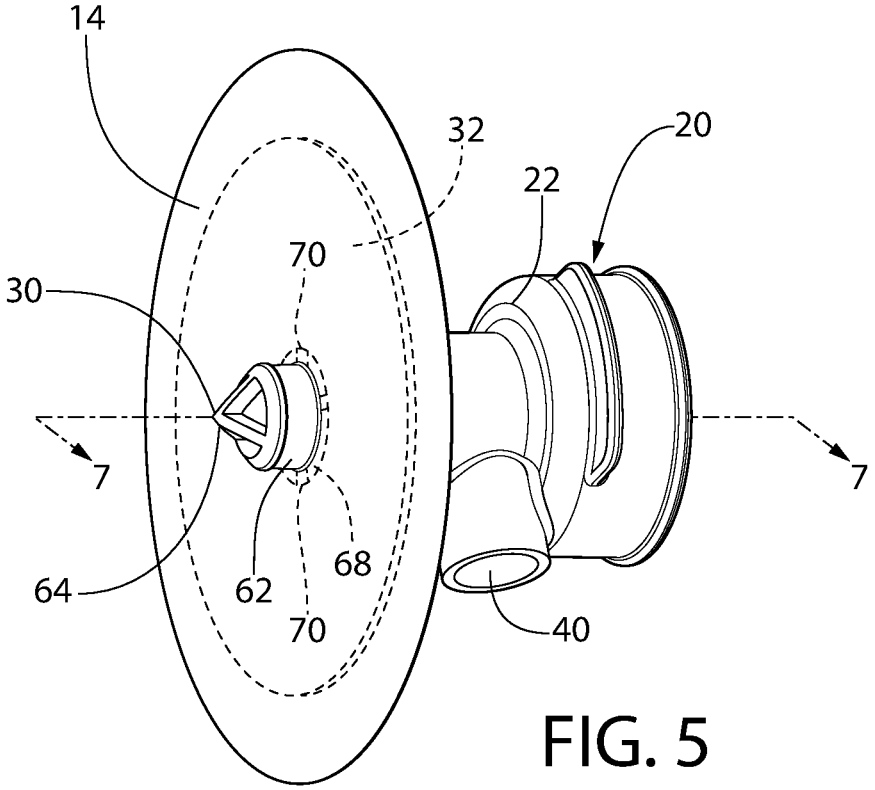
FIG. 5 is an isometric view of the package of FIG. 1 shown after a portion of it has pierced through the wall of the bag like shown in FIG. 4 and with the valve in its closed state.

When the piercing member 30 is in its extended position, its tip section 64 will be located within the bag and the flange 68 of its tubular section 62 will be located outside the outer surface of the wall of the bag contiguous with the frangible penetration zone 14A but still within the central passageway 36, as best seen in FIG. 5. Moreover, a portion of the bag's wall contiguous with the frangible zone will be in engagement with the undercut annular recess 62A as shown in FIG. 4. This action effectively locks the piercing member in position and thus ensures that the portion of the piercing member within the bag's interior remains therein.

The length of the plunger 24 is selected so that before first use of the fitment its piercing member 30 is spaced from the frangible zone of the bag's wall and the valve 26 is in its normally closed state, such as shown in FIGS. 2 and 3.

Operation of the fitment 20 will now be described. To that end, when it is desired to initially dispense liquid from the interior of the bag 10, the user merely presses on the depression 56 at the apex of the bulb 50 to collapse the bulb. This action causes the plunger 24 to slide along the passageway 36 guided by the rails 70 from the retracted position shown in FIG. 3, to the extended position shown in FIG. 5. The movement of the plunger in that direction causes the pusher surfaces of the walls 72 and 74 to engage the planar proximal surface 68A of the piercing member, thereby concomitantly moving the piercing member along the axis A, whereupon the pointed distal section 64 of the piercing member penetrates the wall of the bag at the frangible zone. When the plunger has been moved to its maximum extended position the piercing member's tip section 64 and the contiguous portion of the tubular section 62 will be located within the bag's interior with its flange 68 located on the outer surface of the wall of the bag. This action permanently locks those portions of the piercing member within the bag's interior. Moreover, the movement of the plunger in the distal direction causes the valve member 46 to move away from its valve seat 48, thereby bringing the fitment's central passageway 36 into fluid communication with the passageway 44 of the spout 40. Inasmuch as there are spaces between the legs 64A of the tip 64, the liquid within the bag which is represented by the arrows in FIG. 7 can flow through those spaces, into the communicating passageway 66 and from there into the central passageway 36 of the fitment 20. From there the liquid can flow outward through the passageway between the recess 76 of the pusher wall 74 and the proximal surface 68A of the piercing member, through the space between the valve member 46 and the valve seat 48 to the passageway 44 in the spout and hence out the spout's open end 42. As long as the bulb 50 remains depressed by the user, the valve will be maintained in its open state so that the desired amount of liquid can be dispensed through the fitment.

When it is desired to halt the dispensing of the liquid from the bag all that is required is for the user to stop depressing the bulb 50, whereupon the natural resiliency of the bulb will cause it to reassume its un-flexed state, thereby automatically carrying the plunger 24 and its integral valve member 46 back to the retracted position. Thus, as soon as the valve member 46 has re-engaged the valve seat 48, the flow of liquid through the fitment will be immediately stopped, i.e., the two compression seals formed between the valve seat and the surfaces 46A and 46B will isolate the central passageway 36 from the spout passageway 44.

If after the flow of liquid has been stopped, additional liquid is desired to be dispensed from the bag, all which is required is for the user to re-depress the bulb 50 to cause the valve member 46 to move off of the valve seat 48. Inasmuch as the piercing member had been permanently moved to its operating position within the bag during the first depression of the bulb, the opening of the valve will result in the liquid within the bag being permitted to flow through the now open valve and out of the fitment. The liquid from the bag will continue to flow out of the bag through the fitment's spout for as long as the user presses on the bulb, or until the bag is devoid of its liquid contents, whichever occurs first.

As should be appreciated by those skilled in the art the dispensing of the liquid from the bag when the fitment's valve is in its open state will automatically draw down the liquid within the bag, thereby causing the bag's walls to collapse toward each other. Such action could have the effect of interrupting the flow of the liquid out of the bag if a portion of the collapsing walls of the bag move into engagement to block inlet to the fitment. However, the presence of the piercing member within the bag tends to prevent any such action. In particular, once the actuator has been initially depressed to cause the piercing member to pierce through the frangible zone of the bag so that a portion of the piercing member is permanently located within the bag the presence of that portion of the piercing member will hold any wall portion of the bag from the fitment's inlet, thereby ensuring that so long as there is any liquid within the bag it will be enable to flow out when the valve is in the open state. Moreover, the presence of the piercing member within the bag tends to spread open a larger outlet in the bag to enhance flow as compared to merely having a slit in the bag.

Turning now to FIGS. 12-21, there is shown another, and more preferred, exemplary package 110 constructed in accordance with this invention. The package 110 is arranged for holding and dispensing a flowable material, e.g., a liquid, therefrom by means of a more preferred embodiment of a dispensing fitment 120 constructed in accordance with this invention. The package 110, in the form of a bag or pouch which is identical in construction to the bag 10 described heretofore. Thus, in the interest of brevity the details of the construction of the bag will not be reiterated. In the exemplary embodiment shown in FIG. 12, the fitment 120 is fixedly mounted, e.g., welded, on an exterior surface 12 of a portion of one of the walls making up the bag or pouch. The fitment 120 is similar in many respects to the fitment 20, except that it does not make use of a separate plunger and piercing member, wherein a portion of that piercing member is permanently located within the interior of the bag after first use of the fitment like the fitment 20. Rather, as will be described later, the fitment 120 makes use of a single piercing member coupled to the actuator, and which piercing member is configured to be extended by depressing the actuator to cause it to pierce through the wall of the bag to enable the contents of the bag, e.g., the liquid, to flow out of the fitment's spout. The piercing member automatically retracts out of the bag and back into the fitment upon release of the actuator, whereupon a portion of the piercing member cooperates with two annular, circumferential seals to close the outlet port of the spout and thereby prevent the liquid from flowing or dripping out of the fitment. Moreover, and quite significantly, the piercing member includes two piercing portions, to be described later, which are configured to sequentially penetrate the wall of the bag at the penetration zone to facilitate the formation of an opening in the wall of the bag through which the liquid can flow. In particular, in one preferred exemplary embodiment shown in FIGS. 12-21, the piercing member includes a first piercing portion or point which is a leading portion of the piercing member and serves to initially penetrate the wall of the bag. The second piercing portion is in the form plural, secondary piercing points followed by elongated cutting edges located proximally of the first piercing point and which serve to produce cross-sectioned flaps from the material forming the wall of the bag at the penetration zone. Those flaps are easily folded away (backward into the interior of the bag) from the small opening created by the first piercing portion as the piercing member is extended into the bag. This action minimizes stretching of the film material making up the wall of the bag while facilitating its tearing to reduce the force required to fully penetrate the wall of the bag. Subsequent actuations of the actuator deploy the piercing member back through the pierced wall of the bag, while folding the flaps formed by the initial penetration out of the flow path to thereby maximize the flow through that path.

Figure 13:
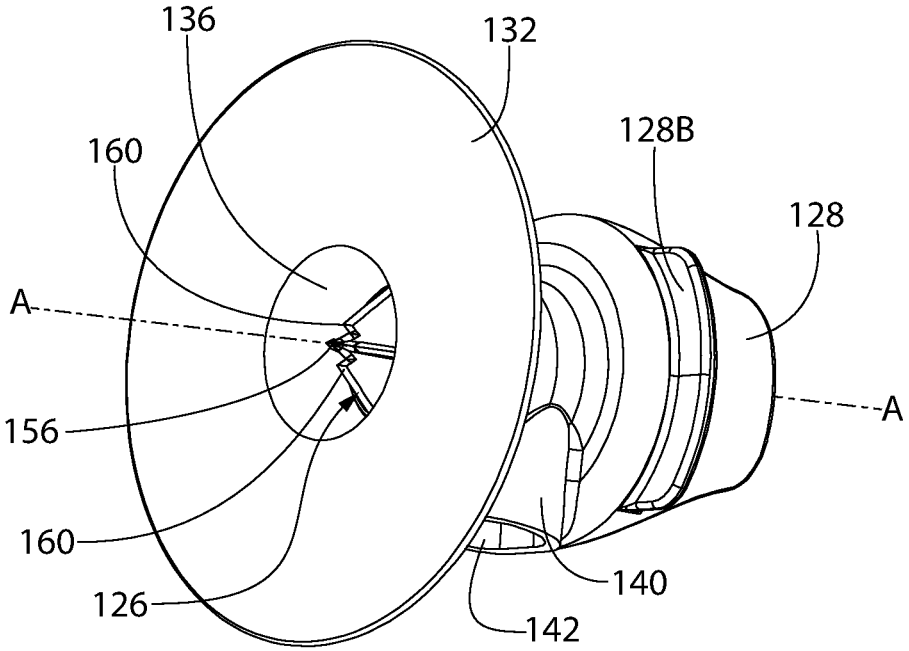
FIG. 13 is an isometric view of the fitment shown in FIG. 12, wherein the fitment is shown prior to being secured to the bag.

The fitment 120 basically comprises an assembly of a body or housing 122, an actuator 124, and a piercing member 126 (FIG. 13). The body 122 is a molded, hollow component which is formed of the same material as the body 22 and has a planar flange 132 configured to be fixedly secured, e.g., welded, to the outer surface of a portion of the wall 14 of the bag 10. The portion of the body 122 contiguous with the flange is in the form of a collar 134. The collar 134 includes a flange 134A projecting outward from its proximal end. The flange 134A is configured to receive a portion of the wall of the box between it and the flange 132, when the fitment 120 is used as a part of a bag-in-box package. It should be pointed out that such use is merely exemplary, such that the fitment 120 can be used for other applications than bag-in-box.

Figure 14:
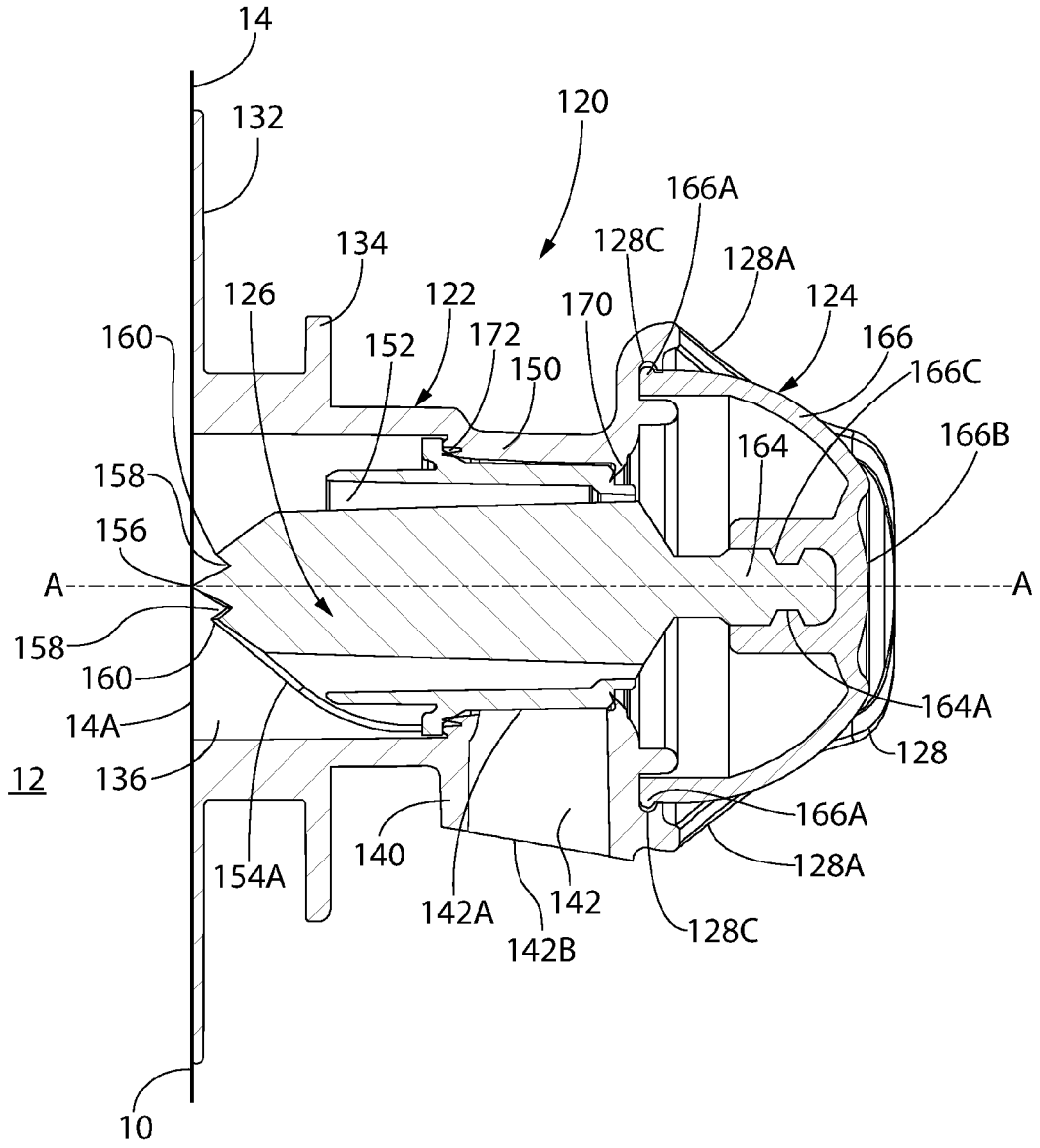
FIG. 14 is an enlarged sectional view taken along line 14-14 of FIG. 12, wherein the fitment is shown in its initial state prior to first use.
Figure 15:
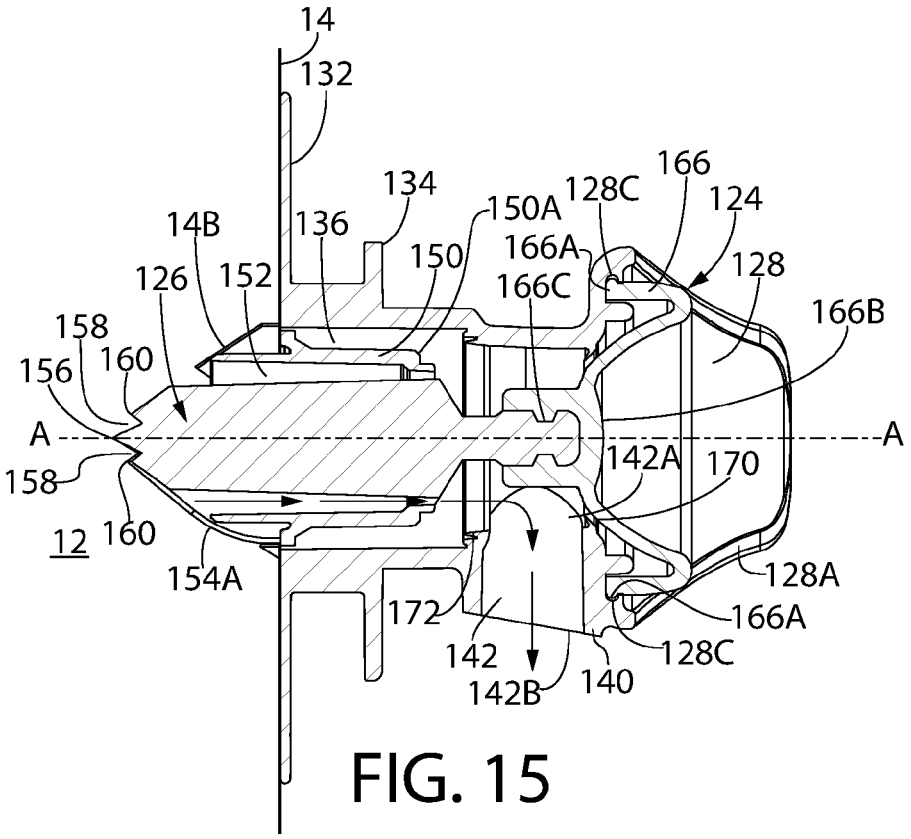
FIG. 15 is a reduced sectional view, similar to FIG. 14, but showing the fitment during its first use, whereupon a portion of the fitment has pierced the wall of the bag so that the flowable contents in the bag is enabled to flow out of the fitment through the fitment's exit port.

The body 122 of the fitment 120 includes a central passageway 136 extending partially through it. The passageway is centered about a longitudinally extending axis A. The passageway 136 is at the end of the body 122 contiguous with the flange 132 and is open, whereupon the frangible penetration zone 14A of the wall 14 of the bag is in communication with the passageway 136. The open end of the central passageway 136 is best seen in FIGS. 13 and 14 and forms the inlet to the fitment 120 through which the liquid in the bag may enter when the frangible penetration zone of the bag is pierced.

The opposite end of the fitment's body 122 is in the form of a hollow tubular throat 128, which is centered on the axis A and whose inside diameter is larger than the inside diameter of the passageway 136. The actuator 124, which is in the form of a depressable bulb (which will be described later), is located within the throat 128. The throat 128 includes a pair of diametrically opposed recesses 128A to facilitate the actuation (depression) of the bulb. In addition, the throat includes a pair of tabs or flanges 128B projecting outward from the exterior surface of the throat between the recesses. The flanges 128B serves as a means which can be held by a user's index finger and middle finger, while the user's thumb presses on the bulb to operate the actuator. The portion of the body 122 located between the throat 128 and the collar 134 is in the form of a spout 140. It is through the spout that the liquid is dispensed from the interior 12 of the bag 10. To that end, the spout 140 constitutes a tubular portion of the body having a passageway 142 which extends generally perpendicularly to the longitudinal central axis A. The inner end of the passageway 142 forms the outlet port 142A of the fitment 120 and is in fluid communication with the passageway 136. The outer end 142B of the passageway 142 is open so that any liquid from the interior of the bag that enters the outlet port 142A from the passageway 136 will exit the spout at the open end 142B.

The piercing member 126, which will be described in detail shortly, is located within the central passageway 136 of the body 122 and includes wall portions which are configured to close the outlet port 142A and thus block the spout to prevent any liquid from entering the spout when the piercing member is in its retracted (normal) state, like shown in FIG. 14. In particular, those wall portions of the piercing member are configured to engage two annular circumferential seals (also to be described later) in the passageway 136 to ensure that there is no leakage or dripping of the liquid from the spout when the piercing member is in the retracted state.

Figure 18:
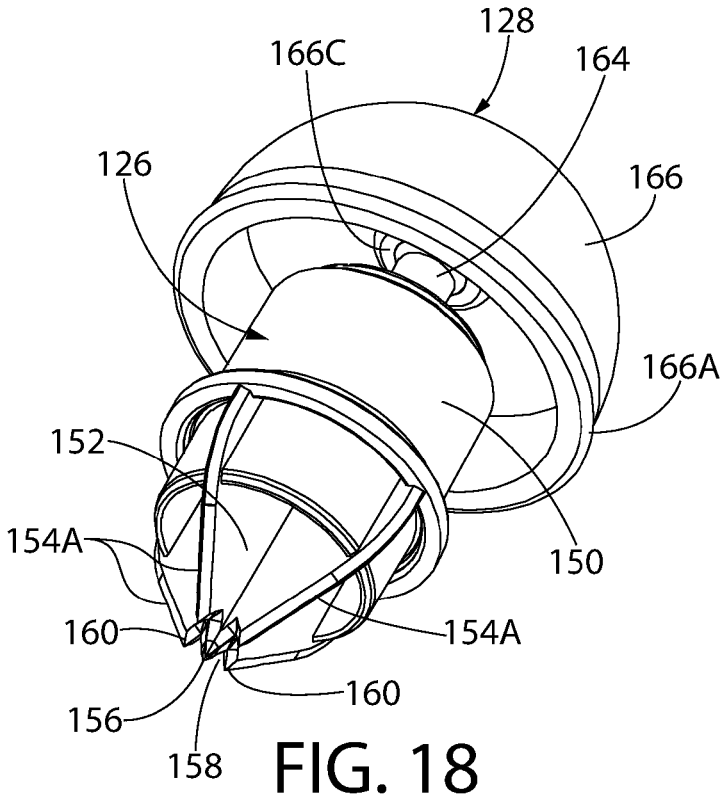
FIG. 18 is an enlarged isometric view of a portion of some of the components of the fitment shown in FIGS. 12-17.
Figure 20:
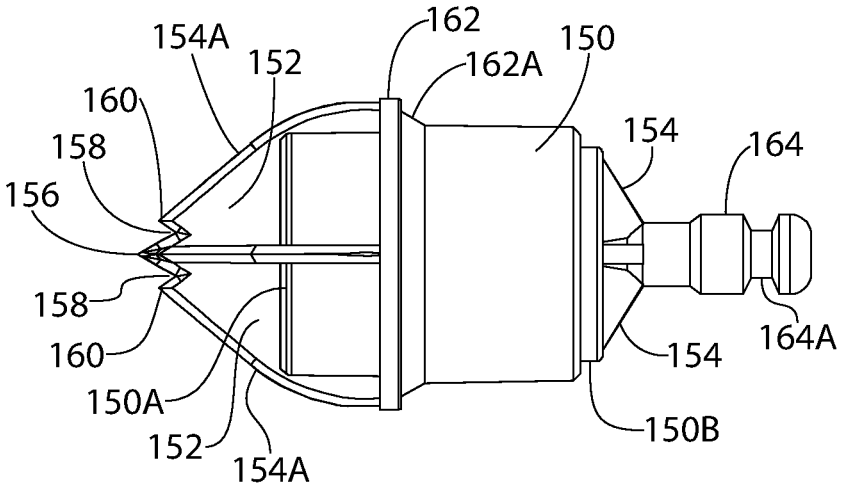
FIG. 20 is a side elevation view of several of the components of the fitment shown in FIGS. 12-17.
Figure 21:
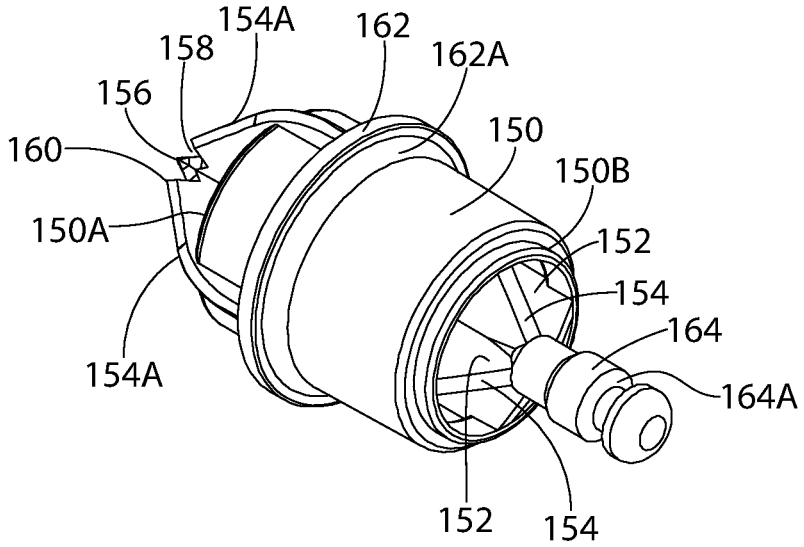
FIG. 21 is an isometric view of the components shown in FIG. 20.

The piercing member 126 is best seen in FIGS. 18, 20 and 21 and is preferably formed as an integral unit of the same material as that making up the piercing member 30 of the fitment 20. The piercing member 126 basically comprises a cylindrical or barrel shaped body having a circular sidewall 150 bounding a hollow interior in which is divided into four passageways 152 by four walls 154. The walls 154 extend perpendicularly to each other to form a cruciform wall structure within the bounds of the sidewall 150. The passageways 152 extend the length of the sidewall 150 from its open distal end 150A to its open proximal end 150B and thus form paths through the piercing member through which the liquid from the bag can pass when the piercing member is in its extended position, as will be described later. The distal end of the walls 154 of the piercing member are in the form of a sharp piercing point or tip 156. The tip 156 forms the heretofore mentioned leading portion of the piercing member and is configured to initially penetrate the material, e.g., film, making up the wall 14 of the bag 10 at the penetration zone 14A. The distal end portion 154A of each of the walls 154 is V-shaped in cross-section to form an elongated sharp cutting edge 154A. Each cutting edge 154A tapers toward the piercing tip 156 from the distal end of the sidewall 150 to the tip 156. A V-shaped notch 158 is located contiguous proximally to the piercing point 156 in each cutting edge 154A to form respective secondary piercing points 160 at the distal end of each of the cutting edges 154A but proximally of the piercing tip 156.

The secondary piercing points and the contiguous cutting edges 154 located proximally thereof serve to create the cross-sectioned flaps, designated by the reference number 14B, in the material making up wall of the bag at the frangible penetration zone 14A when the piercing member is extended through the wall of the bag. An annular flange 162 (FIGS. 20 and 21) extends about the periphery of the sidewall 150 at the proximal end of the cutting edges 154. The proximal end surface 162A of the flange 162 is conical and tapers downward in the proximal direction. The proximal end of the walls 154 of the piercing member 126 terminate at a central rod 164 that extends along the axis A from the point at which the walls 154 merge together. The proximal end of the rod 164 includes an annular recess 164A that is configured to be fixedly secured to the actuator 124.

The actuator 124 comprises a depressible member configured to be repeatedly depressed and released to effect its operation. In the exemplary embodiment shown the actuator is in the form of a compressible bulb 166 formed of any suitable resilient material, e.g., the same material as used for bulb 50 of the fitment 20 and is similarly constructed to the bulb 20. To that end, the bulb 166 is of generally hemispheric shape having an annular peripheral flanged rim 166A (FIGS. 14, 15, and 18) which is secured within a correspondingly shaped annular recess 128C located at the bottom of the throat 128. The apex of the compressible bulb 166 is in the form of a slight depression 166B. The inner surface of the bulb at the location of the depression 166B is in the form of a socket 166C in which the proximal end of the rod 164 is fixedly secured.

Figure 16:
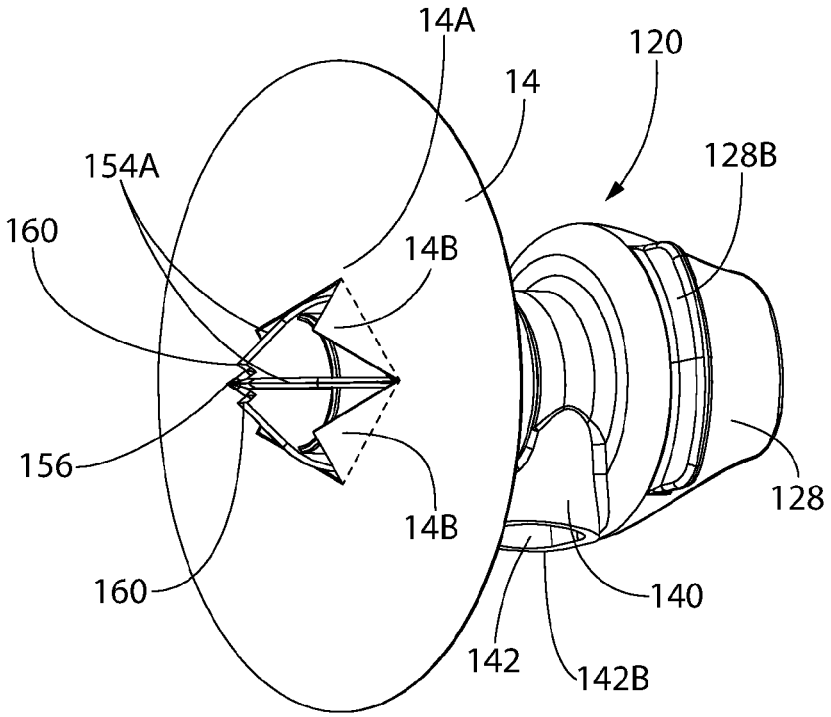
FIG. 16 is an isometric view of the package of FIG. 12 shown after a portion of the fitment has pierced through the wall of the bag, like shown in FIG. 15.

The bulb 166 is configured to be depressed by the user to collapse the bulb. This action has the effect of sliding the piercing member 126 through the central passageway 136 in body of the fitment 120 along the axis A to its extended position, whereupon the distal or leading piercing point 156 engages the wall of the bag at the penetration zone 14A to pierce through it. Further inward movement of the piercing member by the depression of the bulb 166 causes the secondary piercing tips 160 to engage the wall of the bag contiguous with the portion that the leading piercing tip 156 engaged, thereby beginning the formation of four, triangularly shaped flaps 14B at the penetration zone. Further inward movement of the piercing member causes the tapered cutting edges 154A to cut into to material of the wall of the bag to complete the formation of the four flaps 14B and to fold them backward into the interior of the bag as best seen in FIG. 16. Accordingly, the liquid (or other flowable contents of the bag 10) can flow through the now pierced wall 14 of the bag into and through the passageways 152 and out of those passageways at the proximal end of the sidewall 150 in the flow path as shown by the arrows in FIG. 15. At this time the proximal end of the sidewall 150 will be located distally of the outlet port 142A so that the outlet port 142A will be open and the liquid from the passageways 152 can enter it, from whence that liquid will flow through the passageway 142 and out of the open end 142B of the spout.

Figure 17:
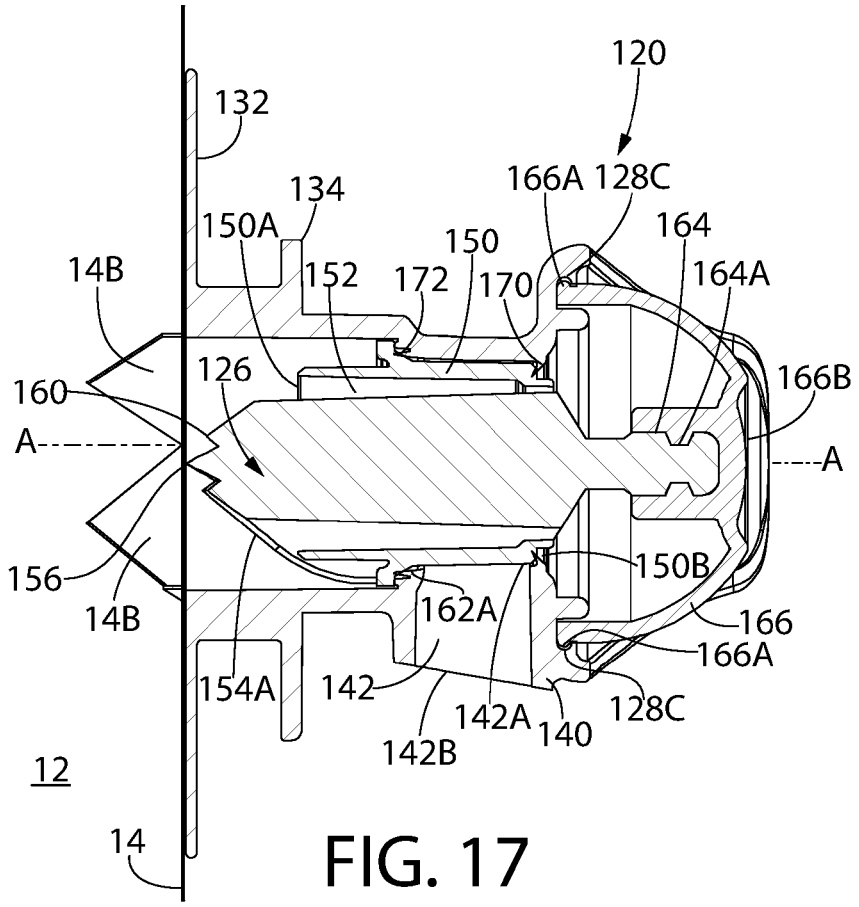
FIG. 17 is a sectional view, similar to FIG. 15, but showing the fitment after its actuator has been released to automatically carry the piercing member out of the bag and thereby close the fitment's outlet port to halt the flow of the bag's contents out of the fitment.
Figure 19:
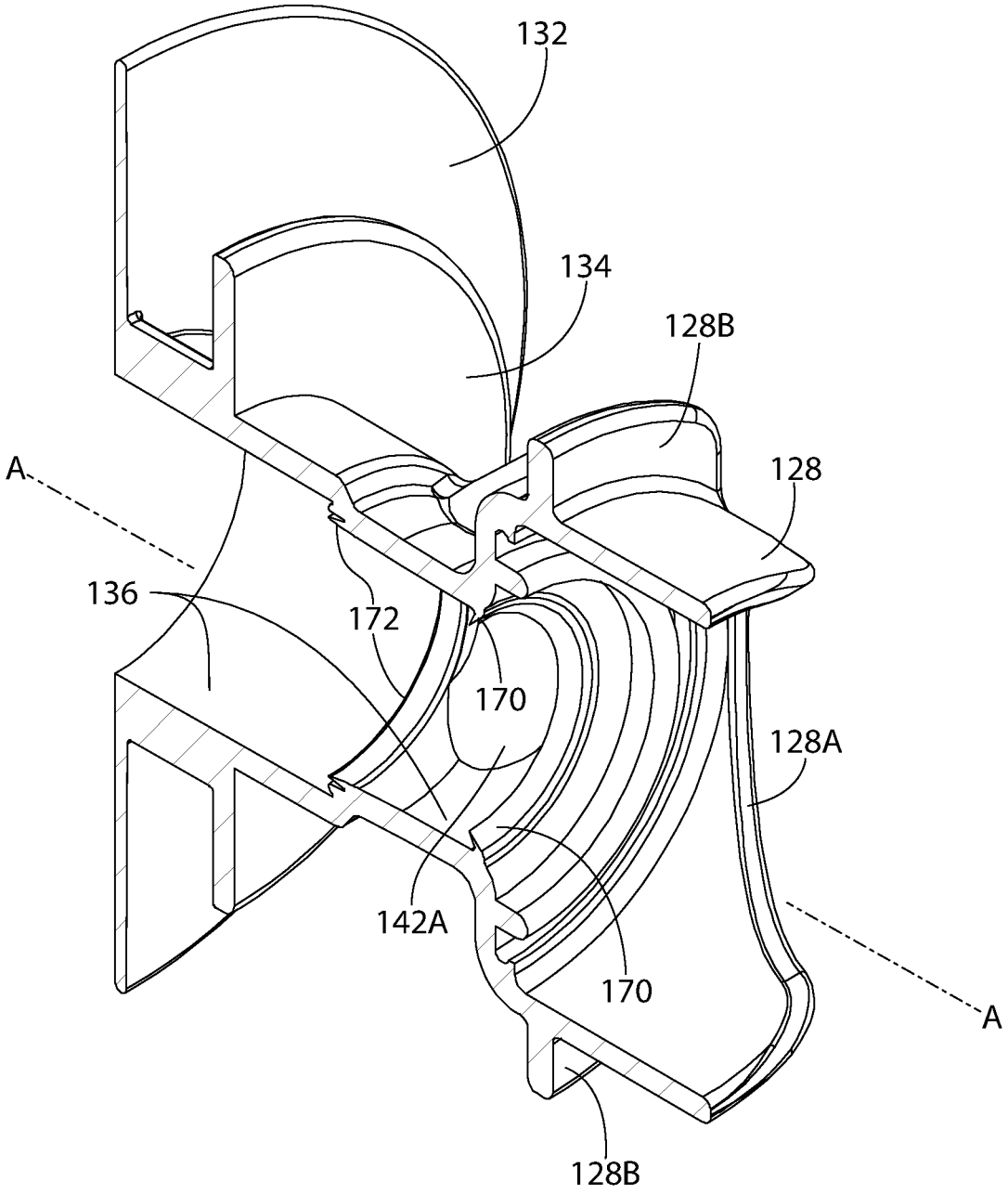
FIG. 19 is an enlarged isometric view, partially in section, showing one component, i.e., the body or housing of the fitment of FIG. 12.

Turning now to FIGS. 14, 17 and 19, the details of the heretofore mentioned annular circumferential seals will now be described. To that end, as can best be seen in FIG. 19, the passageway 136 includes a first seal in the form of a circumferential wedge-shaped fin 170 extending inward into the passageway 136 located immediately adjacent the proximal side of the outlet port 142A. The fin 170 is shaped somewhat like the valve seat 48 of the fitment 20 and is oriented to that it extends generally perpendicularly to the axis A. The seal 170 is configured to form a fluid-tight interface with the proximal end surface 150B of the sidewall 150 when the piercing member is in the retracted position or state, like shown in FIG. 14. The second seal is in the form of a circumferential fin 172 extending inward into the passageway 136 located immediately adjacent the distal side of the outlet port 142A. The fin 172 is wedge shaped and oriented so that it extends generally parallel to the axis A. The seal 172 is configured to form a fluid-tight interface with the proximal end surface 162A of the annular flange 162 of sidewall 150 when the piercing member is in the retracted position or state, like shown in FIG. 14.

Inasmuch as the compressible bulb 166 is formed of a resilient material, the release of pressure on the bulb by the user enables the bulb to automatically reassume (e.g., flex back) its normal un-collapsed state, whereupon the piercing member 126 is carried back to its retracted position. That action brings the proximal end surface 162A of the annular flange 162 of the piercing member into a fluid-tight sealing engagement with the fin 172 and proximal end surface 150B of the sidewall 150 into a fluid-tight sealing engagement with the fin 170, whereupon the outlet port 142A is isolated from the central passageway 136 so that the flow of liquid out of the fitment is halted.

Operation of the fitment 120 will now be described. When it is desired to initially dispense liquid from the interior of the bag 10, the user merely presses on the depression 166 at the apex of the bulb 166 to collapse the bulb. This action causes the piercing member 126 to slide along the central passageway 136 from the retracted position shown in FIG. 14, to the extended position shown in FIG. 15. The movement of the piercing member in that direction first causes the pointed distal end 156 of the piercing member to penetrate the wall of the bag at the frangible zone 14A to initially penetrate it, whereupon the secondary piercing points 160 and their adjacent cutting edges 154A cut into the wall material to form the four flaps 14B and to fold those flaps backward into the interior 12 of the bag. This action forms a port in the bag (referred to hereinafter as the "film port") through which the liquid can exit the bag. Thus, the liquid within the bag which is represented by the arrows in FIG. 15 can flow through the film port into and through the passageways 152 in the piercing member, from whence it flows out of the end of those passageways and into the outlet port 142A. From there the liquid flows out of the open end of the spout, as long as the bulb remains depressed by the user. Thus, as long as the bulb remains depressed by the user, the fitment 120 will be maintained in its open state so that a desired amount of liquid can be dispensed through the fitment 120.

When it is desired to halt the dispensing of the liquid from the bag all that is required is for the user to stop depressing the bulb 166, whereupon the natural resiliency of the bulb will cause it to reassume its un-flexed state, thereby automatically carrying the piercing member 126 back to its retracted position. Thus, as soon as the heretofore described surface portions 150B and 162A of the cutting member engage the seals 170 and 172, respectively, the flow of liquid through the fitment will be immediately stopped by the isolation of the outlet port 142A from the central passageway 136.

If, after the flow of liquid has been stopped, additional liquid is desired to be dispensed from the bag, all that is required is for the user to re-depress the bulb to cause the piercing member to move back to its extended position, whereupon the distal end portion of the piercing member will cause the flaps 14B at the film port to again fold backward and out of the fluid flow path, while holding the flaps open so that the distal end portion of the piercing member is within the interior of the bag, whereupon the liquid can flow through the piercing member and the outlet port, as described above. The liquid from the bag will continue to flow out of the bag through the fitment's spout for as long as the user presses on the bulb, or until the bag is devoid of its liquid contents, whichever occurs first.

It must be pointed out at this juncture that the exemplary embodiments of the fitment as described above are merely examples of many types of fitments that can be constructed in accordance with this invention. For example, it is contemplated that the annular seals 170 and 172 may form respective portions of the piercing member, rather than forming portions of the body 122. Moreover, other types of sealing arrangements can be used so that when the piercing member is in its retracted position, the flow of liquid through the fitment is stopped, e.g., the outlet port is sealed. Further still, while it is preferred that the piercing member be constructed as described above to produce the heretofore identified flaps, other cutting arrangements can be used in the piercing member to achieve the same end.

Thus, while the invention has been described in detail and with reference to specific examples thereof, it will be apparent to one skilled in the art that various changes and modifications can be made therein without departing from the spirit and scope thereof.

We claim:

1. A fitment for package holding a liquid therein, said fitment being configured for selectively dispensing a quantity of the liquid from the package, the package comprising a flexible bag having a hollow interior in which the liquid is disposed and a wall contiguous with the hollow interior, said a fitment comprising;

a body having a portion configured for securement to the wall of the bag, a passageway, and an outlet in communication with said passageway;

an actuator comprising a moveable member configured to be repeatedly moved from one position to another position and vice versa;

a plunger coupled to said actuator and configured to be moved through said passageway in one direction to an extended position upon the movement of said actuator from said one position to said another position and moved through said passageway in a second and opposite direction to a retracted position in response to the movement of said actuator from said another position to said one position;

a valve coupled to said actuator and configured to be in either an open state or a closed state, said valve being in said open state when said actuator is in said one position and being in said closed state when said actuator is in said another position; and a piercing member comprising a hollow member coupled to said plunger and located in said passageway, said plunger when moved to said extended position causing said piercing member to pierce through the wall of the bag, whereupon a portion of said piercing member is permanently disposed within the hollow interior of the bag and a portion of said piercing member is located outside of the bag, said valve when in said open state enabling the liquid within the hollow interior of the bag to flow out of the bag through said piercing member and said passageway to said outlet.

2. The fitment of claim 1 wherein said valve comprises a movable valve member and a valve seat, said moveable valve member being mounted on said plunger and movable therewith into and out of engagement with said valve seat.

3. The fitment of claim 1 wherein said piercing member comprises a tubular proximally located section and pointed distally located section.

4. The fitment of claim 1 wherein said actuator comprises a bulb formed of a resilient material.

5. A package for holding and dispensing a quantity of a liquid therefrom, said package comprising:

a flexible bag having a hollow interior in which the liquid is located and a wall contiguous with said hollow interior; and a dispensing fitment comprising:

a body having a portion configured for securement to the wall of the bag, a passageway, and an outlet in communication with said passageway;

an actuator comprising a member configured to be repeatedly moved from one position to another position and vice versa;

a plunger coupled to said actuator and configured to be moved through said passageway in one direction to an extended position upon the movement of said actuator from said one position to said another position and moved through said passageway in a second and opposite direction to a retracted position in response to the movement of said actuator from said another position to said one position;

a valve coupled to said actuator and configured to be in either an open state or a closed state, said valve being in said open state when said actuator is depressed and being in said closed state when said actuator is released; and a piercing member comprising a hollow member coupled to said plunger and located in said passageway, said plunger when moved to said extended positon causing said piercing member to pierce through said wall of said bag, whereupon a portion of said piercing member is permanently disposed within said hollow interior of said bag and a portion of said piercing member is located outside of said bag, said valve when in said open state enabling the liquid within said hollow interior of said bag to flow out of said bag through said piercing member and said passageway to said outlet.

6. The package of claim 5 wherein said valve comprises a movable valve member and a valve seat, said moveable valve member being mounted on said plunger and movable therewith into and out of engagement with said valve seat.

7. The package of claim 5 wherein said piercing member comprises a tubular proximally located section and pointed distally located section.

8. The package of claim 5 wherein said actuator comprises a bulb formed of a resilient material.

9. A fitment for package holding a liquid therein, said fitment being configured for selectively dispensing a quantity of the liquid from the package, the package comprising a flexible bag having a hollow interior in which the liquid is disposed and a wall contiguous with the hollow interior, said a fitment comprising:

a body having a portion configured for securement to the wall of the bag, a passageway, and an outlet port in communication with said passageway;

an actuator comprising a member configured to be repeatedly moved from one position to another position and vice versa; and a piercing member comprising a hollow cylindrical section having an outer surface and being coupled to said actuator and configured to be moved in one direction through said passageway and through the wall of the bag to an extended position upon the movement of said actuator from said one position to said another position and moved through said passageway in a second and opposite direction to a retracted position in response to the movement of said actuator from said another position to said one position, one of said passageway and said outer surface of said piercing member comprising at least one seal, said outer surface of said piercing member and said at least one seal forming a fluid tight interface therebetween, said piercing member including a portion blocking said outlet port when said piercing member is in said fully retracted position, and unblocking said outlet portion when said piercing member is moved to said extended position, thereby enabling the liquid within the hollow interior of the bag to flow out of the bag through said hollow cylindrical section of said piercing member and said passageway to said outlet.

10. The fitment of claim 9 wherein said one of said passageway and said outer surface of said piercing member comprises said passageway.

11. The fitment of claim 10 wherein said at least one seal comprises a circumferential seal.

12. The fitment of claim 11 wherein said at least one seal comprises two circumferential seals, one of said circumferential seals being located on one side of said outlet port between said outlet port and said portion of said body configured for securement to the wall of the bag, and the other of said circumferential seals being located on an opposite side of said outlet port between said outlet port and said actuator.

13. The fitment of claim 9 wherein said piercing member comprises a leading piercing tip and plural secondary piercing tips located proximally of said leading piercing tip, said leading piercing tip being configured to pierce through the wall of the bag when said piercing member is first moved to said extended position, whereupon said secondary piercing tips pierce through the wall of the bag to create cross-sections flaps at the portion of the wall of the bag that is pierced by the piercing member, the flaps created by said secondary piercing tips being foldable to facilitate subsequent extensions of said piercing tip to said extended position and to provide an enhanced fluid path through the pierced wall of the package.

14. The fitment of claim 13 wherein said piercing member comprises portions for holding said flaps in a folded state enhancing the fluid path through the pierced wall of the package upon subsequent movements of said piercing member to said extended position after the initial movement of said piercing member to said extended position.

15. The fitment of claim 12 wherein said piercing member comprises a leading piercing tip and plural secondary piercing tips located proximally of said leading piercing tip, said leading piercing tip being configured to pierce through the wall of the bag when said piercing member is first moved to said extended position, whereupon said secondary piercing tips pierce through the wall of the bag to create cross-sections flaps at the portion of the wall of the bag that is pierced by the piercing member, the flaps created by said secondary piercing tips being foldable to facilitate subsequent extensions of said piercing tip to said extended position.

16. The fitment of claim 9 wherein said actuator comprises a bulb formed of a resilient material.

17. A package for holding and dispensing a quantity of a liquid therefrom, said package comprising;

a flexible bag having a hollow interior in which the liquid is located and a wall contiguous with said hollow interior; and a dispensing fitment comprising:

a body having a portion configured for securement to said wall of said bag, a passageway, and an outlet port in communication with said passageway;

an actuator comprising a member configured to be repeatedly moved from one position to another position and vice versa; and a piercing member comprising a hollow cylindrical section having an outer surface and being coupled to said actuator and configured to be moved in one direction through said passageway and through said wall of said bag to an extended position upon the movement of said actuator from said one position to said another position and moved through said passageway in a second and opposite direction back through said wall of said bag and through said passageway to a fully retracted position in response to the movement of said actuator from said another position to said one position, one of said passageway and said outer surface of said piercing member comprising at least one seal, said outer surface of said piercing member and said at least one seal forming a fluid tight interface therebetween, said piercing member including a portion blocking said outlet port when said piercing member is in said fully retracted position, and unblocking said outlet portion when said piercing member is moved to said extended position, thereby enabling the liquid within the hollow interior of the bag to flow out of the bag through said hollow cylindrical section of said piercing member and said passageway to said outlet.

18. The package of claim 17 wherein said one of said passageway and said outer surface of said piercing member comprises said passageway.

19. The package of claim 18 wherein said at least one seal comprises a circumferential seal.

20. The package of claim 19 wherein said at least one seal comprises two circumferential seals, one of said circumferential seals being located on one side of said outlet port between said outlet port and said portion of said body configured for securement to the wall of the bag, and the other of said circumferential seals being located on an opposite side of said outlet port between said outlet port and said actuator.

21. The package of claim 17 wherein said piercing member comprises a leading piercing tip and plural secondary piercing tips located proximally of said leading piercing tip, said leading piercing tip being configured to pierce through the wall of the bag when said piercing member is first moved to said extended position, whereupon said secondary piercing tips pierce through the wall of the bag to create cross-sections flaps at the portion of the wall of the bag that is pierced by the piercing member, the flaps created by said secondary piercing tips being foldable to facilitate subsequent extensions of said piercing tip to said extended position and to provide an enhanced fluid path through the pierced wall of the package.

22. The package of claim 21 wherein said piercing member comprises portions for holding said flaps in a folded state enhancing the fluid path through the pierced wall of the package upon subsequent movements of said piercing member to said extended position after the initial movement of said piercing member to said extended position.

23. The package of claim 20 wherein said piercing member comprises a leading piercing tip and plural secondary piercing tips located proximally of said leading piercing tip, said leading piercing tip being configured to pierce through the wall of the bag when said piercing member is first moved to said extended position, whereupon said secondary piercing tips pierce through the wall of the bag to create cross-sections flaps at the portion of the wall of the bag that is pierced by the piercing member, the flaps created by said secondary piercing tips being foldable to facilitate subsequent extensions of said piercing tip to said extended position.

24. The package of claim 17 wherein said actuator comprises a bulb formed of a resilient material.

25. The package of claim 23 wherein said actuator comprises a bulb formed of a resilient material.

* * * * *